US006771778B2

(12) United States Patent
Kirkeby

(10) Patent No.: US 6,771,778 B2
(45) Date of Patent: Aug. 3, 2004

(54) METHOD AND SIGNAL PROCESSING DEVICE FOR CONVERTING STEREO SIGNALS FOR HEADPHONE LISTENING

(75) Inventor: Ole Kirkeby, Espoo (FI)

(73) Assignee: Nokia Mobile Phonés Ltd., Espoo (FI)

( * ) Notice: Subject to any disclaimer, the term of this patent is extended or adjusted under 35 U.S.C. 154(b) by 333 days.

(21) Appl. No.: 09/967,620

(22) Filed: Sep. 28, 2001

(65) Prior Publication Data

US 2002/0039421 A1 Apr. 4, 2002

(30) Foreign Application Priority Data

Sep. 29, 2000 (FI) ..... 20002163

(51) Int. Cl.[7] ..... H04R 5/00; H04R 5/02

(52) U.S. Cl. ..... 381/17; 381/1; 381/18; 381/309

(58) Field of Search ..... 381/17, 1, 18, 381/309

(56) References Cited

U.S. PATENT DOCUMENTS

| | | | | |
|---|---|---|---|---|
| 3,920,904 A | | 11/1975 | Blauert et al. | 179/1 G |
| 3,970,787 A | | 7/1976 | Searle | 179/1 AT |
| 4,136,260 A | | 1/1979 | Asahi | 179/1 G |
| 4,388,494 A | * | 6/1983 | Schone et al. | 381/1 |
| 4,748,669 A | | 5/1988 | Klayman | 381/1 |
| 5,181,248 A | * | 1/1993 | Inanaga et al. | 381/310 |
| 5,371,799 A | | 12/1994 | Lowe et al. | 381/25 |
| 5,502,747 A | | 3/1996 | McGrath | 375/350 |
| 5,596,644 A | | 1/1997 | Abel et al. | 381/17 |
| 5,659,619 A | | 8/1997 | Abel | 381/17 |
| 5,802,180 A | | 9/1998 | Abel et al. | 381/17 |
| 5,809,149 A | * | 9/1998 | Cashion et al. | 381/17 |
| 5,812,674 A | | 9/1998 | Jot et al. | 381/17 |

FOREIGN PATENT DOCUMENTS

| | | | |
|---|---|---|---|
| EP | 0 438 281 B1 | 1/1991 | H04S/1/00 |
| EP | 0 674 467 A1 | 10/1994 | H04S/1/00 |
| EP | 0966179 A2 | 12/1999 | H04S/3/00 |
| WO | 97/25834 | 7/1997 | H04S/1/00 |
| WO | 98/20707 | 5/1998 | H04S/1/00 |

OTHER PUBLICATIONS

Schone, P. 1981. Ein Beitrag zur Kompatibilitat raumbezogener und kopfbezogener Stereophonie. Acustica, vol 47, No. 3, pp. 170 to 177. West Germany.

* cited by examiner

*Primary Examiner*—Minsun Oh Harvey
*Assistant Examiner*—Devona E Faulk

(57) ABSTRACT

The invention relates to a method for converting signals in two-channel stereo format to become suitable to be played back using headphones. The invention also relates to a signal processing device for carrying out said method. According to the invention left direct path ($L_d$) and left cross-talk path ($L_X$) signals are formed from the left input signal ($L_{in}$), and correspondingly right direct path ($R_d$) and right cross-talk path ($R_X$) signals are formed from the right input signal ($R_{in}$), and further the left output signal ($L_{out}$) is formed by combining said left direct-path ($L_d$) and said right cross-talk path ($R_x$) signals, and correspondingly, the right output signal ($R_{out}$) is formed by combining said right direct-path ($R_d$) and said left cross-talk path ($L_x$) signals. The direct path signals ($L_d$,$R_d$) each are formed using filtering (1,3) associated with first frequency dependent gain ($G_d$) and the cross-talk path signals ($L_x$,$R_x$) each are formed using filtering (2,4) associated with second frequency dependent gain ($G_x$) and by adding interaural time difference (ITD) (5,6).

16 Claims, 6 Drawing Sheets

Figure 2:
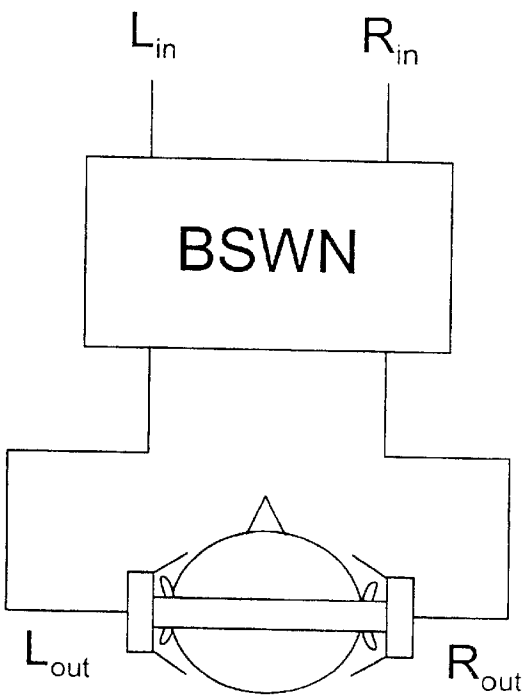

METHOD AND SIGNAL PROCESSING DEVICE FOR CONVERTING STEREO SIGNALS FOR HEADPHONE LISTENING

The present invention relates to a method according to the preamble of the appended claim 1 for converting signals in two-channel stereo format to become suitable to be played back using headphones. The invention also relates to a signal processing device according to the preamble of the appended claim 7 for carrying out said method.

Already for several decades the prevailing format for making music and other audio recordings and public broadcasts has been the well-known two-channel stereo format. The two-channel stereo format consists of two independent tracks or channels; the left (L) and the right channel, which are intended for playback using two separate loudspeaker units. Said channels are mixed and/or recorded and/or otherwise prepared to provide a desired spatial impression to a listener, who is positioned centrally in front of the two loudspeaker units spanning ideally 60 degrees with respect to the listener. When a two-channel stereo recording is listened through the left and right loudspeakers arranged in the above described manner, the listener experiences a spatial impression resembling the original sound scenery. In this spatial impression the listener is able to observe the direction of the different sound sources, and the listener also acquires a sensation of the distance of the different sound sources. In other words, when a two-channel stereo recording is listened, the sound sources seem to be located somewhere in front of the listener and inside the area substantially located between the left and the right loudspeaker unit.

Other audio recording formats are also known, which, instead of only two loudspeaker units, rely on the use of more than two loudspeaker units for the playback. For example, in a four channel stereo system two loudspeaker units are positioned in front of the listener: one to the left and one to the right, and two other loudspeaker units are positioned behind the listener: to the rear left and to the rear right, respectively. This allows to create a more detailed spatial impression of the sound scenery, where the sounds can be heard coming not only somewhere from the area located in front of the listener, but also from behind, or directly from the side of the listener. Such multichannel playback systems are nowadays commonly used for example in movie theatres. Recordings for these multichannel systems can be prepared to have independent tracks for each separate channel, or the information of the channels in addition to a normal two-channel stereo format can also be coded into the left and right channel signals in a two-channel stereo format recording. In the latter case a special decoder is required during the playback to extract the signals for example for the rear left and rear right channels.

Further, some special methods are known in order to prepare recordings, which are specially intended to be listened through headphones. These include, for example, binaural recordings that are made of recording signals corresponding to the pressure signals that would be captured by the eardrums of a human listener in a real listening situation. Such recordings can be made for example by using a dummy-head, which is an artificial head equipped with two microphones replacing the two human ears. When a high-quality binaural recording is listened through headphones, the listener experiences the original, detailed three-dimensional sound image of the recording situation.

The present invention is however mainly related to such two-channel stereo recordings, broadcasts or similar audio material, which have been mixed and/or otherwise prepared to be listened through two loudspeaker units, which said units are intended to be positioned in the previously described manner with respect to the listener. Hereinbelow, the use of the short term "stereo" refers to aforementioned kind of two-channel stereo format, if anything else is not separately mentioned. The listening of audio material in such stereo format through two loudspeakers is hereinbelow shortly referred to as "natural listening".

During the last decade portable personal stereo devices, such as portable tape- and CD-players, for example, have become increasingly popular. This development has, among other things, strongly increased the use of headphones in the listening of music recordings, radio broadcasts etc. However, the commercially available music recordings and other audio material are almost exclusively in the two-channel stereo format, and thus intended for playback over loudspeakers and not over headphones. Despite of this fact, it is common to the portable stereo devices, and also to other playback systems, that they do not make any attempt to compensate for the fact that stereo recordings are intended for playback over loudspeakers and not over headphones.

When a stereo recording is played back over loudspeakers in a natural listening situation, the sound emitted from the left loudspeaker is heard not only by the listener's left ear but also by the right ear, and correspondingly the sound emitted from the right loudspeaker is heard both by the right and left ear. This condition is of primary importance for the generation of a hearing impression with a correct spatial feeling. In other words, this is important in order to generate a hearing impression in which the sounds seem to originate from a space or stage outside. When listening a stereo recording over headphones, the left channel is heard in the left ear only, and the right channel is heard in the right ear only. This causes the hearing impression to be both unnatural and tiresome to listen to, and the sound scenery or stage is contained entirely inside the listener's head: the sound is not externalised as intended.

Prior art methods, that are intended for improving the sound quality of two-channel stereo recordings when presented over headphones, come mainly in the following two types.

The first type of methods is based on the emulation of a natural listening situation, in which situation the sound would normally be reproduced through loudspeakers. In other words, the stereo signals played back through the headphones are processed in order to create in the listener's ears an impression of the sound coming from a pair of "virtual loudspeakers", and thus further resembling the listening to the real original sound sources. Methods belonging to this category are referred later in this text as "virtual loudspeaker methods".

The second type of methods is not based on attempting to create an accurate natural listening or natural sound scenery at all, but they rely on methods such as adding reverberation, boosting certain frequencies, or boosting simply the channel difference signal (L minus R). These methods have been empirically found to somewhat improve the hearing impression. Later in this text methods belonging to this category are referred as "equalizers" or "advanced equalizers".

In the following, the virtual loudspeaker method and the methods based on different types of equalizers are discussed in somewhat more detail.

If sound is emitted from a loudspeaker positioned for example to the left side of the listener, it is possible to determine the sound pressures created at the listener's left and right ear. Comparing the loudspeaker input signal to the sound pressure signals observed at the listener's left and right ear, it is possible to model the behaviour of the acoustic path that transfers the sound to the listener's ears. When this is performed separately for both the left and right channels, it is further possible to realize signal filters, which can be used to process the loudspeaker input signals according to the behaviour of said acoustic paths. By processing the original signals using such filters, and playing back the filtered signals through headphones, ideally same sound pressures are reproduced at the listener's ears as in the case of listening the original signals through loudspeakers. The above described virtual loudspeaker method is thus, at least in theory, a scientifically justified and credible method to emulate the natural listening conditions.

Each of the acoustic paths is made up of three main components: the radiation characteristics of the sound sources (such as a pair of loudspeakers), the influence of the acoustic environment (which causes early reflections from nearby surfaces and late reverberation), and the presence of the receiver (a human listener) in the sound field. The loudspeaker is usually not modelled explicitly, rather it is assumed to have a flat magnitude response and an omni-directional radiation pattern. The reflections from the acoustic environment are used by the listener to form an impression of the surroundings, and by modelling the early reflections [U.S. Pat. Nos. 5,371,799; 5,502,747; 5,809,149] and the late reverberation [U.S. Pat. Nos. 5,371,799; 5,502,747; 5,802,180; 5,809,149; 5,812,674], it is possible to give the listener the impression of being in an enclosed space. However, when using the given prior art methods this cannot be achieved without making a noticeable and negative change to the overall sound quality.

The effect of the receiver on the incoming sound waves, and in particular the effect of the human head and pinna (outer ear, earlobe), has been studied intensively by the research community for several decades. An acoustic path which includes a realistic modelling of the listener's head, and possibly the listener's torso and/or pinna, is usually referred to as a head-related transfer function (HRTF). HRTFs are usually measured on so-called dummy-heads under anechoic conditions, and it is common practice to equalize, i.e. to correct the raw measured data for the response of the transducer chain, which typically consists of an amplifier, a loudspeaker, a microphone, and some data acquisition equipment. The HRTF to the ear closest to the loudspeaker is referred to as the ipsilateral HRTF, whereas the HRTF to the other ear further away from the loudspeaker is referred to as the contralateral HRTF.

The human auditory system combines, and compares the sounds filtered by the ipsilateral and contralateral HRTFs for the purpose of localising a source of sound. It is a generally accepted fact that the auditory system uses different mechanisms to localise sound sources at low- and high frequencies. At frequencies below approximately 1 kHz, the acoustical wavelength is relatively long compared to the size of the listener's head, and this causes an interaural phase difference to take place between the sound waves originating from a sound source (loudspeaker) and arriving to the listener's two ears. Said interaural phase difference can be translated into an interaural time difference (ITD), which in other words is the time delay between the sound arriving at the listener's closest and furthest ear. For sound sources in the horizontal plane, a large ITD means that the source is to the side of the listener whereas a small ITD means that the source is almost directly in front of, or directly behind, the listener.

At frequencies above approximately 2 kHz the acoustical wavelength is shorter than the human head, and the head therefore casts an acoustic shadow that causes an interaural level difference (ILD) to take place between the sound waves originating from a sound source and arriving at the listener's two ears. In other words, the sound pressures arriving at the listener's closest and furthest ear are different. At frequencies above 5 kHz, the acoustical wavelength is so short that the pinna contributes to large variations in interaural level difference ILD as a function of both the frequency and the position of the sound source.

Thus, localisation of sound sources at low frequencies is mainly determined by interaural time difference ITD cues whereas localisation of sound sources at high frequencies is mainly determined by interaural level difference ILD cues.

Prior art systems that implement the virtual loudspeaker method over headphones attempt to include both low frequency ITD cues and high-frequency ILD cues, at least to the extent that ILD is not constant above 3 kHz. There are many ways in which this high-frequency variation can be extracted and implemented [U.S. Pat. Nos. 3,970,787; 5,596,644; 5,659,619; 5,802,180; 5,809,149; 5,371,799; and also WO 97/25834]. One system even exaggerates the ILD in order to achieve a more convincing spatial effect [EP 0966 179 A2].

In practice, the drawbacks of the aforementioned virtual loudspeaker-type methods concentrate on the amount of detail contained in an accurate model of the acoustic paths, and further on the difficulties in being able to accurately design and realize the necessary signal filters. Today such filters can best be realized using digital signal processing techniques (DSP). However, the dynamic range of the necessary digital filters is rather large, and this has the undesirable side-effect that the filters introduce unwanted colouration of the reproduced sound. This colouration of the sound takes place especially at the higher frequencies, and it is particularly noticeable on high-fidelity recordings.

Methods that fall into categories of "equalizers" or "advanced equalizers" cannot be considered to be so-called spatial enhancers in the strict sense of this definition, since they do not succeed in really externalising any part of the sound scenery. The basic idea of boosting the channel difference signal (L minus R channel) in a two-channel stereo format is based on the observation that the difference signal seems to contain more spatial information than the channel sum signal (L plus R). When headphones are used, the effect of increasing the level of the channel difference signal makes the sound sources at right and left to become more audible, whereas the sound sources near the centre are essentially unaffected. Thus, the sound components that are at the extreme left and extreme right on the sound scenery or stage are effectively made louder, but spatially they still remain at the same locations. However, if the effect boosts the overall sound level by a couple of decibels when it is switched on, it will sound like an improvement. In fact, an increase in the overall sound level will be usually interpreted by the listener as an improvement in the quality of the sound, irrespective of the method by means of which it was exactly accomplished. Most of the "spatializer" or "expander" functions that can be found today for example in tape players, CD-players or PC sound cards, can be considered as kind of advanced equalizers affecting the level of the channel difference signal [U.S. Pat. No. 4,748,669].

A known method is also to use a simple low-frequency boost, which is an effective method especially when used together with headphones. This is because headphones are much less efficient in reproducing low frequencies than loudspeakers. A low-frequency boost helps to restore the spectral frequency balance of the recording in playback, but no spatial enhancement can be achieved.

It is also known, that by adding reverberation to the stereo signals it is possible to give a listener an impression somewhat similar to the one experienced when listening music in a room or other similar closed space. It is well known that the ratio between direct sound and reflected, reverberated sound affects the human sensation of how far the sound source is experienced to be. The more reverberation, the farther away the sound source seems to be. However, high-quality, high-fidelity recordings already contain the correct amount of reverberation, and thus adding even more reverberation will degrade the result, usually giving an impression that the recording was performed in a basement or in a bathroom.

The main purpose of the present invention is to produce a novel and simple method for converting two-channel stereo format signals to become suitable to be played back using headphones. The present invention is based on a virtual loudspeaker-type approach and is thus capable of externalising the sounds so that the listener experiences the sound scenery or stage to be located outside his/her head in a manner similar to a natural listening situation. The aforementioned effect attained by using the method according to the invention is later in this text referred to as "stereo widening".

To attain this purpose, the method according to the invention is primarily characterized in what will be presented in the characterizing part of the independent claim 1.

Furthermore, it is the purpose of this invention to attain a signal processing device which implements the method according to the invention. The signal processing device according to the invention is primarily characterized in what will be presented in the characterizing part of the independent claim 7.

The other dependent claims present some preferred embodiments of the invention.

The basic idea behind the present invention is that it does not rely on detailed modelling of interaural level difference ILD cues, especially the high-frequency ILD cues; rather it omits excessive detail in order to preserve the sound quality. This is achieved by associating the high frequency ILD with a substantially constant value (equal for both channels L and R) above a certain frequency limit $f_{HIGH}$, and also by associating the low frequency ILD with an another substantially constant value below a certain frequency limit $f_{LOW}$.

In addition, the invention further sets the magnitude responses of the ipsilateral and contralateral HRTFs in such a way that their sum remains substantially constant as a function of frequency. Hereinbelow this is referred to as "balancing" and it is different from prior art methods, including the ones described in WO 98/20707 and U.S. Pat. No. 5,371,799 which manipulate the contralateral HRTF only while maintaining a substantially flat magnitude response of the ipsilateral HRTF over the entire frequency range.

The method and device according to the invention are significantly more advantageous than prior art methods and devices in avoiding/minimizing unwanted and unpleasant colouration of the reproduced sound in the case of high-quality and high-fidelity audio material. In addition, the method according to the invention requires only a modest amount of computational power, being thus especially suitable to be implemented in different types of portable devices. The stereo widening effect according to the invention can be implemented efficiently by using fixed-point arithmetic digital signal processing by a specific filter structure.

An considerable advantage of the present invention is that it does not degrade the excellent sound quality available today from digital sound sources as for example Compact-Disk players, MiniDisk players, MP3-players and digital broadcasting techniques. The processing scheme according to the invention is also sufficiently simple to run in real-time on a portable device, because it can be implemented at modest computational expense using fixed-point arithmetic.

When used in connection with the method according to the invention, compared to the sound reproduction via loudspeakers, headphone reproduction has the advantage of not depending on the characteristics of the acoustical environment, or on the position of the listener in that environment. The acoustics of a car cabin, for example, is very different from the acoustics of a living room, and the listener's position relative to the loudspeakers is also different, and not necessarily ideal in these two situations. Headphones, however, sound consistently the same regardless of the acoustic environment, and further, if the type and characteristics of headphones are known in advance, it is possible to design a system which gives good sound reproduction in all situations. Furthermore, the capabilities of the modern high-quality and high-fidelity digital recording and playback facilities back up these possibilities well.

The preferred embodiments of the invention and their benefits will become more apparent to a person skilled in the art through the description hereinbelow, and also through the appended claims.

Figure 1:
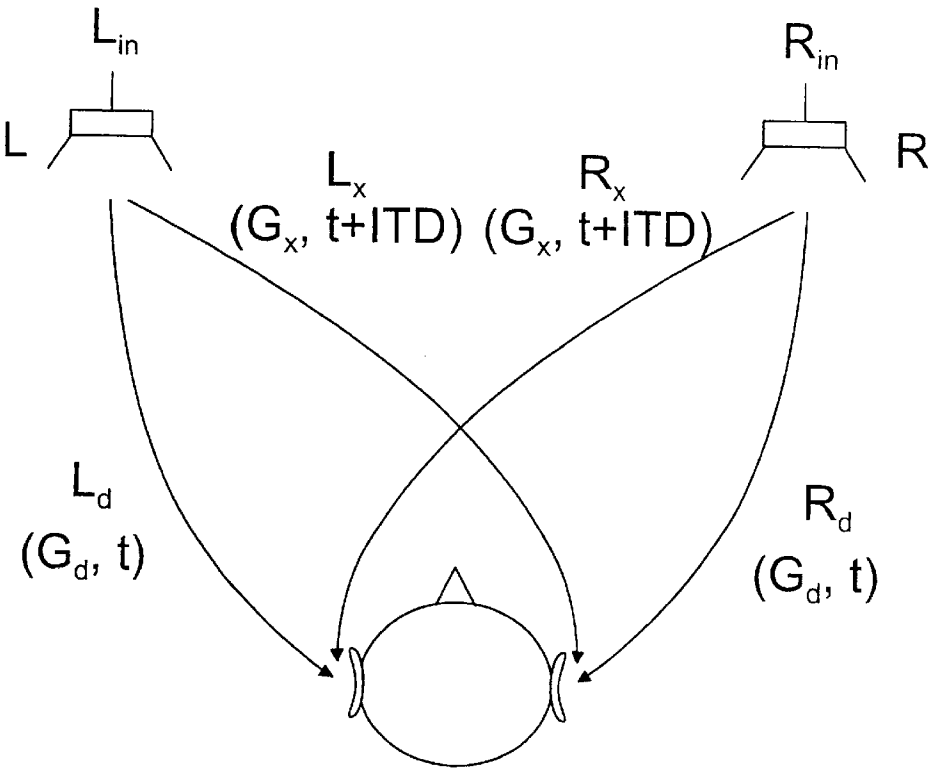
Figure 3:
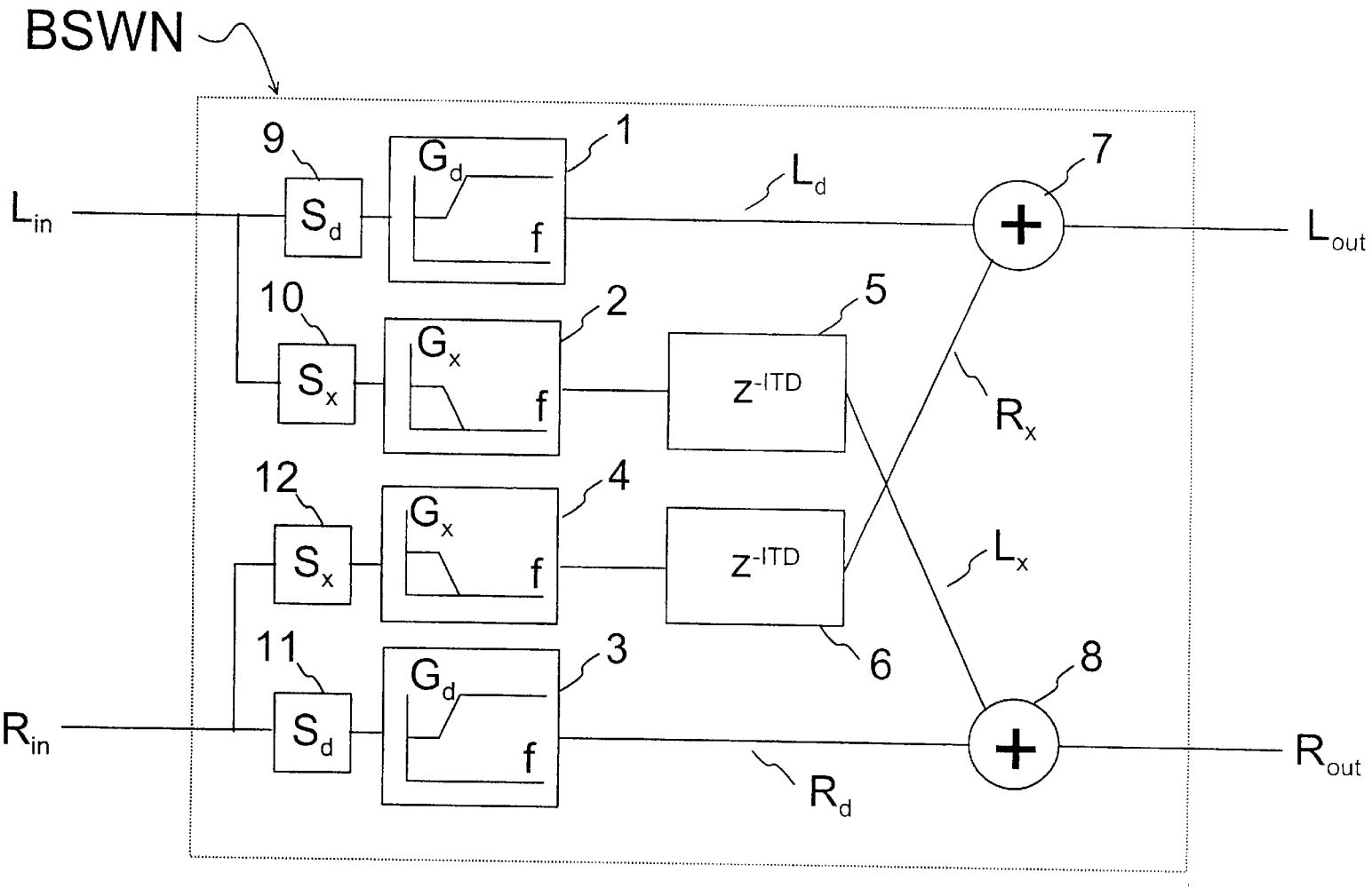
Figure 4A:
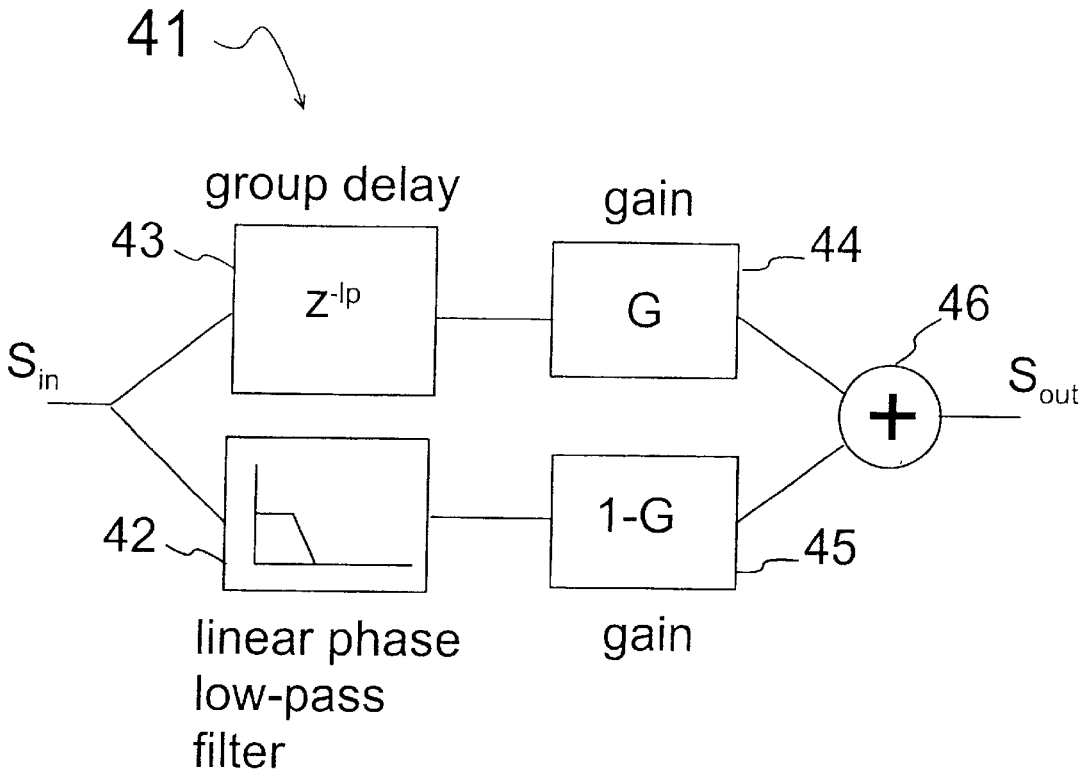
Figure 4B:
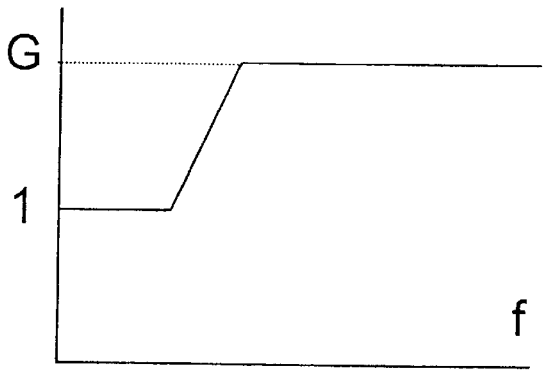
Figure 5:
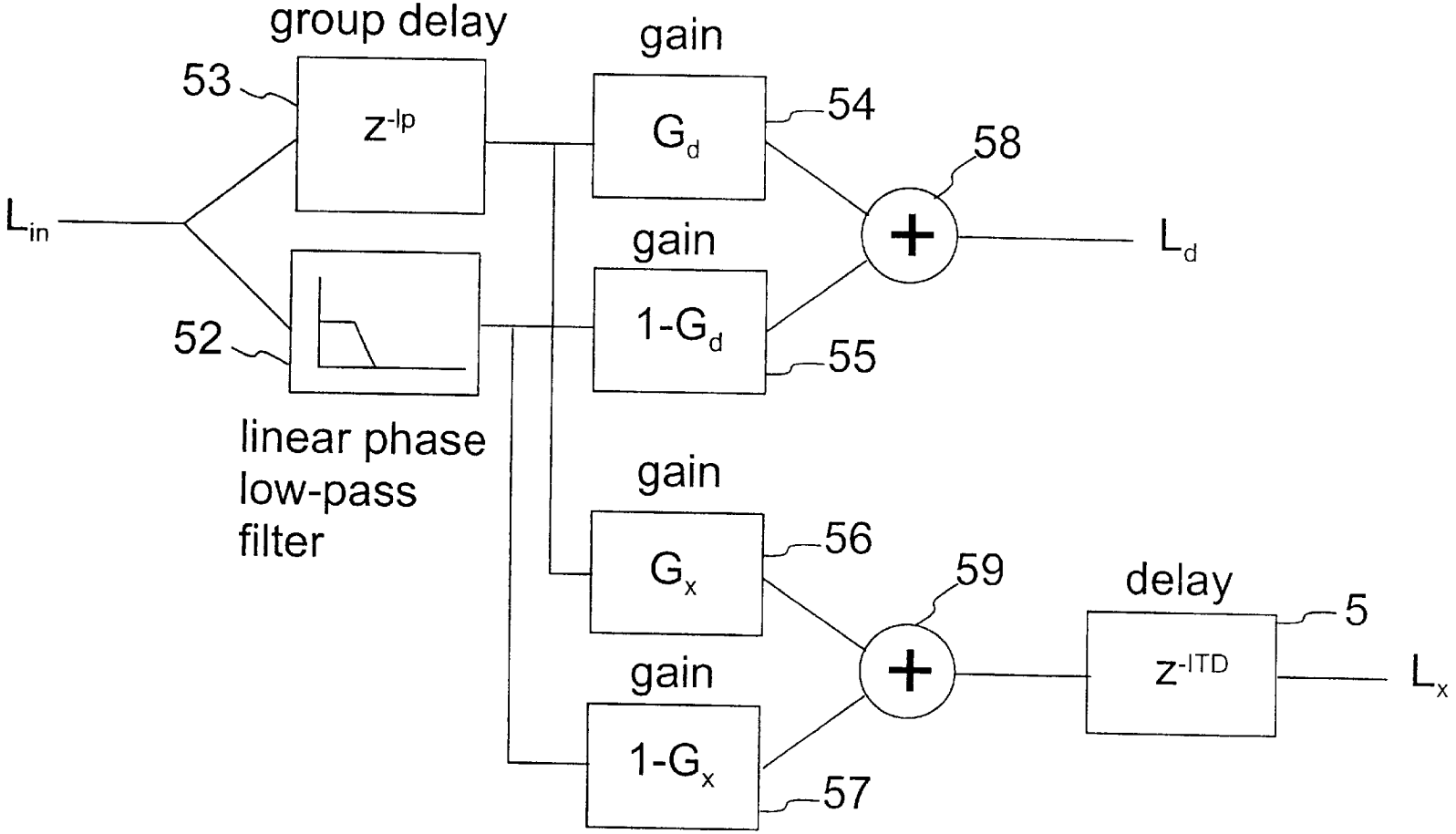
Figure 6:
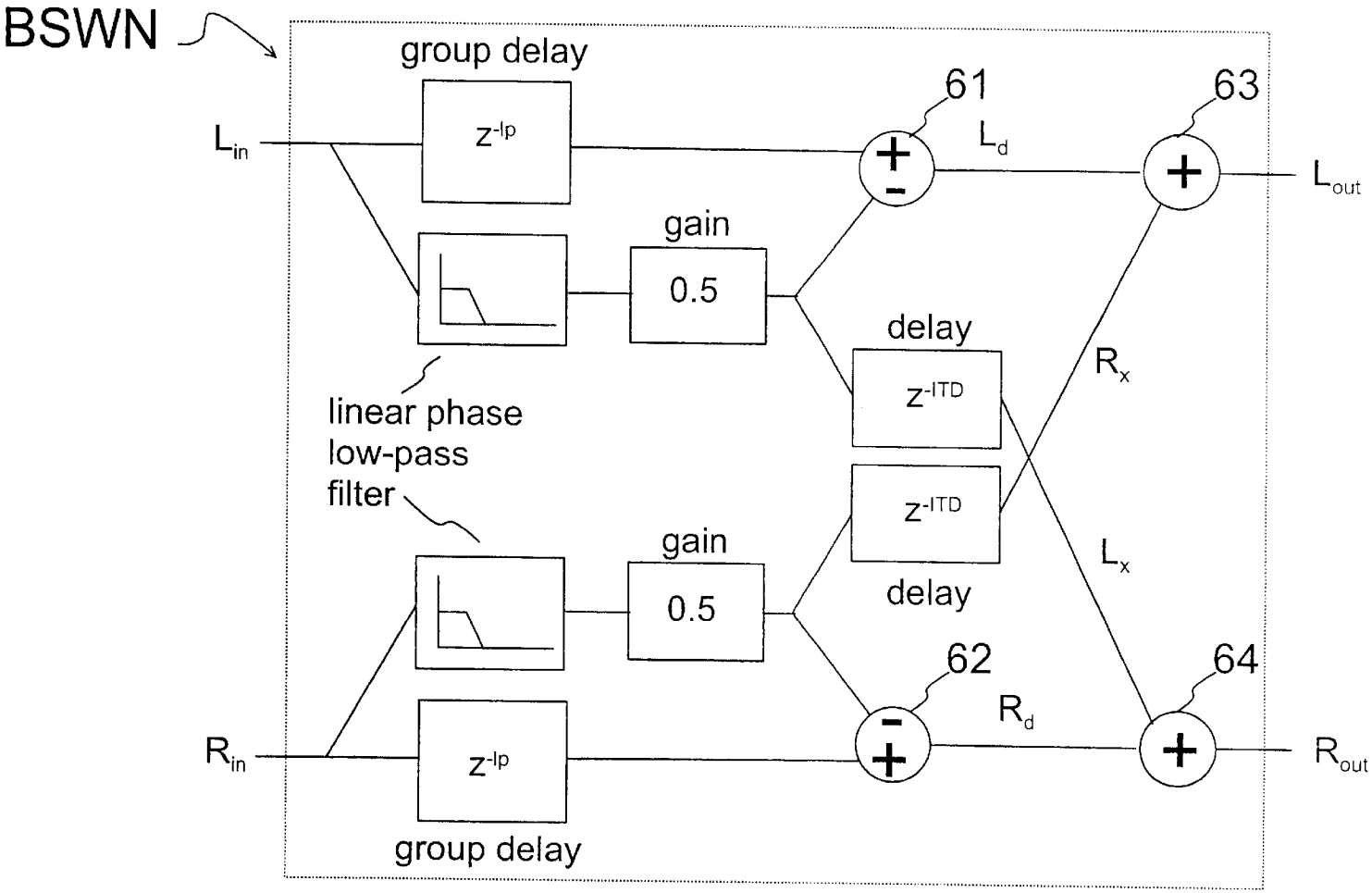
Figure 7:
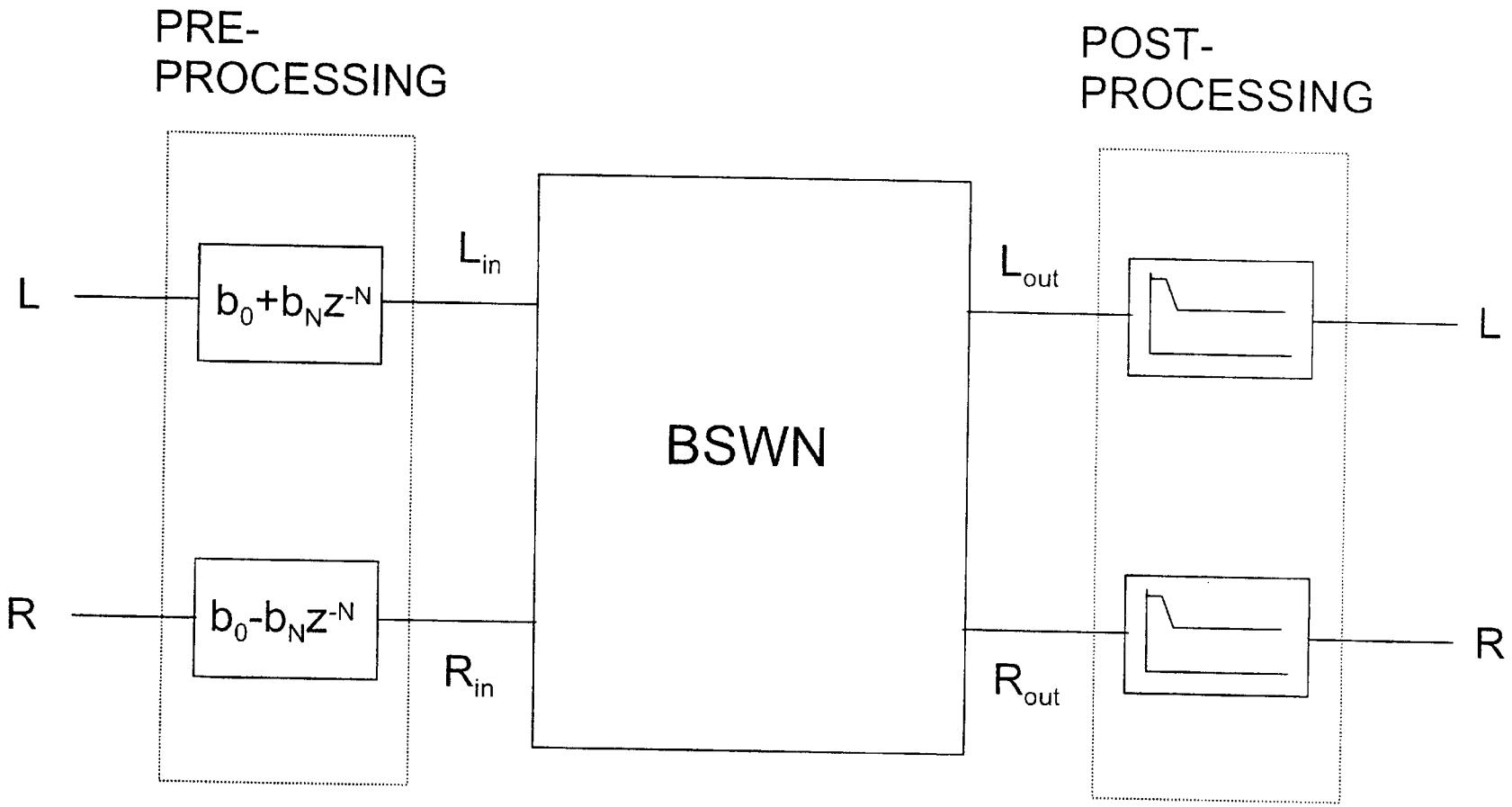

In the following, the invention will be described in more detail with reference to the appended drawings, in which FIG. 1 illustrates natural listening to stereo recording played back through two loudspeaker units, FIG. 2 illustrates the basic idea of the present invention, i.e. the use of a balanced stereo widening network, FIG. 3 shows in more detail the structure of the balanced stereo widening network, FIG. 4*a* shows a block diagram of a digital filter structure used in a preferred embodiment of the balanced stereo widening network, FIG. 4*b* shows the magnitude response of the digital filter structure shown in FIG. 4*a*, FIG. 5 illustrates the use of the digital filter structure shown in FIG. 4*a* in implementing the signal processing elements emulating a virtual loudspeaker to the left of the listener, FIG. 6 shows a block diagram of the balanced stereo widening network using the digital filter structure described in FIGS. 4*a* and 5 in the specific case ($G_d$=2, $G_x$=0), and FIG. 7 illustrates the use of optional pre- and/or post-processing in connection with the balanced stereo widening network.

FIG. 1 illustrates a natural listening situation, where a listener is positioned centrally in front of left and right loudspeakers L,R. Sound coming from the left loudspeaker L is heard at both ears and, similarly, sound coming from the right loudspeaker R is also heard at both ears. Consequently, there are four acoustic paths from the two loudspeakers to the two ears. In FIG. 1 the direct paths are denoted by subscript d ($L_d$ and $R_d$) and the cross-talk paths by subscript x ($L_x$ and $R_x$). However, when the loudspeakers L,R are positioned exactly symmetrically with respect to the listener, the direct path $L_d$ from the left loudspeaker L to the left ear has ideally the same length and acoustic properties as the direct path $R_d$ from the right loudspeaker R to the right ear, and, similarly the cross-talk path $L_x$ from the left loudspeaker L to the right ear has ideally the same length and acoustic properties as the cross-talk path $R_x$ from the right loudspeaker R to the left ear. Thus, both the direct (ipsilateral) path and the cross-talk (contralateral) path can be associated with a frequency-dependent gain, $G_d$ and $G_x$ respectively, and a frequency-dependent delay, t and t+ITD, respectively. The difference between the delays in the direct path and the cross-talk path corresponds to the interaural time difference ITD, and the difference between the gains in the direct path and the cross-talk path corresponds to the interaural level difference ILD.

FIG. 2 shows schematically the basic idea of the present invention. Left and right stereo signals $L_{in}$,$R_{in}$ are processed using a balanced stereo widening network BSWN, which applies the virtual loudspeaker-type method with careful choice of simplified head-related sound transfer functions HRTFs, which said functions can be described by the direct gain $G_d$, the cross-talk gain $G_x$ and the interaural time difference ITD. The aforementioned processing produces signals $L_{out}$ and $R_{out}$, respectively, which signals can be used in headphone listening in order to create a spatial impression resembling a natural listening situation, in which the sound is externalised outside the listener's head.

FIG. 3 shows in more detail the structure of the balanced stereo network BSWN. The left and right channel signals $L_{in}$,$R_{in}$ are divided both into direct and cross-talk paths $L_d$,$L_x$ and $R_d$,$R_x$, respectively. This creates a total of four paths, which paths are all filtered separately using first and second filtering means 1 and 2 for the left direct path $L_d$ and the left cross-talk path $L_x$, respectively, and third and fourth filtering means 3 and 4 for the right direct path $R_d$ and the right cross-talk path $R_x$, respectively. Said filtering means are associated with gains $G_d$ and $G_x$ for the direct paths and cross-talk paths, respectively. Both cross-talk paths $L_x$ and $R_x$ also include delay adding means 5 and 6 for adding the interaural time difference ITD, respectively. Said delay adding means 5 and 6 both have gain equal to one. Left direct path $L_d$ is further summed up with the right cross-talk path $R_x$ using combining means 7 to form left channel output signal $L_{out}$, and right direct path $R_x$ is correspondingly summed up with the left cross-talk path $L_x$ using combining means 8 to form right channel output signal $R_{out}$. In addition, network BSWN includes scaling means 9,10 and 11,12 for scaling each paths $L_d$,$L_x$ and $R_d$,$R_x$ separately.

In order to produce a natural listening impression in headphone listening, the properties ($G_d$, $G_x$) of the filtering means 1,2,3,4 and the properties (ITD) of the delay adding means 5,6 need to be chosen properly. According to the invention, this selection is based on natural listening and behaviour of a set of simplified HRTFs in such situation.

Values for $G_d$ and $G_x$ can be derived by considering the physics of sound propagation. When an object, like the head of a human listener, is positioned in an incident sound field, like one produced by two loudspeakers in a natural listening situation, the sound field is not significantly disturbed by the object if the wavelength of the sound waves is long enough compared to the size of the object. Given the size of a human head, this means that gains $G_d$ and $G_x$ can be taken to be constant as a function of frequency, and further substantially equal to each other at frequencies lower than approximately 1 kHz. At higher frequencies, where the wavelengths of the sound waves become short compared to the size of the object, a pressure build-up takes place on the side of the object which is towards the source of the sound waves, and there will be pressure attenuation taking place on the far side of the object. The latter effect can be referred as shadowing. If the object has relatively simple shape so that it does not significantly focus the sound field, and furthermore, if it is substantially rigid, a pressure doubling will take place on the near side of the object at high frequencies, and no sound waves will reach the shadowed zone on the far side of the object.

On the basis of the facts mentioned above and according to the invention, $G_d$ and $G_x$ can be thus given a value equal to one at frequencies below a certain lower frequency limit denoted $f_{low}$, and $G_d$ can be given a substantially constant value significantly greater than one, and $G_x$ can be given a substantially constant value significantly less than one at frequencies above a certain higher frequency limit $f_{high}$.

In an advantageous embodiment of the invention $G_d$ and $G_x$ are set equal to one at frequencies below $f_{low}$, and $G_d$ is set to 2 and $G_x$ is set to zero at frequencies higher than $f_{high}$. The aforementioned behaviour of the gains $G_d$ and $G_x$ as a function of frequency is schematically illustrated in FIG. 3 in graphs inside the blocks corresponding to the filtering means 1,2 and 3,4. Thus, if neither $G_x$ or $G_d$ varies too rapidly in the transition band between $f_{low}$ and $f_{high}$, the total gain of the sum signal $L_d$+$L_x$, and similarly the total gain of the sum signal $R_x$+$R_x$ is always very close to 2. In this case one can ensure that the network BSWN does not affect the total gain, i.e. amplify the signals, by scaling the direct $L_d$,$R_d$ and cross-talk $L_x$,$R_x$ paths each by a factor of 0.5 prior filtering. This can be accomplished by scaling the signals using scaling means 9,10,11,12. To clarify the aforementioned effect, we can observe the behaviour of a signal, which is connected to input $L_{in}$. At low frequencies below $f_{low}$, said signal passes both filtering means 1 ($G_d$=1) and 2 ($G_x$=1) and due to the aforementioned scaling by 0.5, the sum of the outputs of the filtering means 1 and 2 has not been amplified with respect to the original input signal $L_{in}$. At higher frequencies, the signal passes only filtering means 1 ($G_d$=2), and again due to the scaling by 0.5, the sum of the outputs of the filtering means 1 and 2 has not been amplified with respect to the original input signal $L_{in}$. Consequently, when a pure sine wave signal is used as input $L_{in}$, at low frequencies below $f_{low}$ it is split equally between outputs $L_{out}$ and $R_{out}$, and the sum of the amplitudes of the outputs $L_{out}$ and $R_{out}$ equals to the amplitude of the input $L_{in}$. At higher frequencies above $f_{high}$, the signal passes only through the left channel direct path $L_d$ and the amplitude of the output $L_{out}$ equals the amplitude of the original input $L_{in}$. The above described scaling affects the right channel of the network BSWN in a similar manner, and it is the reason why the stereo widening network BSWN according to the invention is referred to as a balanced network. In yet other words, the sum of the magnitude responses of the corresponding ipsilateral and contralateral HRTFs remain constant as a function of frequency and no net amplification of the signals takes place.

The values of frequency limits $f_{low}$ and $f_{high}$ for filtering in filtering means 1,2,3,4 are not very critical. Suitable value for $f_{low}$ can be, for example, 1 kHz, and for $f_{high}$ 2 kHz. Other values close to these aforementioned values can also be used, flow, however, being always somewhat smaller than $f_{high}$, and the transition frequency band between the said frequency limits should not also be made too wide.

In an advantageous embodiment of the invention, the low-pass characteristics of second filtering means 2 ($L_x$) and fourth filtering means 4 ($R_x$) are made more dramatic than the corresponding effect that it emulates in the real natural listening situation, i.e. in the frequency range above $f_{low}$ the corresponding gain $G_x$ is forced to zero. This prevents unwanted comb-filtering of the monophonic component, i.e. the component which is common to both $L_{in}$ and $R_{in}$, at higher frequencies, which is important so that colouring of the reproduced sound can be avoided in high-quality, high-fidelity recordings. Comb filtering of the monophonic component at low frequencies can be dealt with separately if desired, for example by applying decorrelation, or by applying a method whose purpose essentially is to equalize the monophonic part of the output, either through addition or convolution.

Strictly speaking, the interaural time difference ITD between the direct path and cross-talk path is also frequency dependent, but it can be assumed to be constant in order to simplify the implementation of the method. For sound sources directly in front of the listener the value of ITD is zero, and the highest value encountered when listening to real sound sources is around 0.7 ms, corresponding to the situation where the sound source is directly to the side of the listener. The value of ITD thus affects the amount of widening perceived by the listener. For a desired widening effect the interaural time difference ITD can be selected to have a suitable value larger than zero but less than 1 ms. A value of 0.8 ms, for example, is good for a very high degree of stereo widening, but if ITD is selected to be >1 ms, the result becomes very unnatural and therefore uncomfortable to listen. The embodiments of the invention are however not limited only to such cases where ITD is given a non-frequency dependent constant value. It is also possible to use, for example, an allpass filter to vary the value of ITD as a function of frequency.

FIG. 4*a* shows a block diagram of a simple digital filter structure 41, which can be used to efficiently and advantageously implement the balanced stereo widening network BSWN in practice. The filter structure 41 takes advantage of the known fact that the output of a digital linear phase low-pass filter 42 can be modified so that the result corresponds to the output of another linear phase digital filter that also passes low frequencies straight through, i.e. with gain equal to one, but which said another filter has a different magnitude response at higher frequencies. Thus, a magnitude response of the type shown in FIG. 4*b* can be realised from the output of a digital linear phase low-pass filter 42 with little additional processing. The additional processing requires the use of a separate digital delay line 43, whose length Ip in samples corresponds to the group delay of the low-pass filter 42. The input digital signal stream $S_{in}$ is directed similarly and simultaneously to the inputs of the delay line 43 and the low-pass filter 42. The output of the delay line 43 is multiplied using multiplication means 44 by G, which value of G is the desired high-frequency magnitude response of the filter structure 41. The output of the low-pass filter 42 is multiplied by multiplication means 45 by 1-G. The outputs of the two parallel branches formed by the low-pass filter 42 connected with multiplication means 45, and the delay line 43 connected with multiplication means 42, are added together using adding means 46. In practice, the group delay of the linear phase low-pass filter 42 is in the order of 0.3 ms, which corresponds to 13 samples at 44.1 kHz sampling frequency.

FIG. 5 shows schematically how the digital filter structure 41 shown in FIG. 4*a* can be used to achieve computational saving by directing the left channel digital signal stream $L_{in}$ simultaneously and in parallel into a single digital linear phase low-pass filter 52 and into a digital delay line 53. In this way it is possible to implement the two filters, one for the direct path (first filtering means 1 in FIG. 3) and another for the cross-talk path (second filtering means 2 in FIG. 3) so that in addition to the aforementioned digital low-pass filter 52 and digital delay line 53, only the use of multiplication means 54,55,56,57 and adding means 58,59 is required. Thus, FIG. 5 shows the signal processing elements that emulate a virtual loudspeaker L to the left of the listener and is responsible for the generation of signal paths $L_d$ and $L_x$. FIG. 5 corresponds substantially to the upper half of the balanced stereo widening network BSWN shown in FIG. 3. It is obvious for anyone skilled in the art that the signal processing elements required to emulate the virtual loudspeaker R to the right of the listener can be implemented in a corresponding manner.

FIG. 6 shows a block diagram of the balanced stereo widening network BSWN, which is implemented by using the digital filter structure 41 described above in FIGS. 4*a* and 5, and further corresponds to the specific case when $G_d$ is given a value of 2 and $G_x$, is given a value of zero. In addition, gains $G_d$ (means 54), 1-$G_d$ (means 55), $G_x$ (means 56), 1-$G_x$ (means 57) shown in FIG. 5 for the left channel have each been in FIG. 6 scaled for both the left and right channel by a factor of 0.5 to balance the overall levels of output signals $L_{out}$,$R_{out}$ compared to the levels of the original input signals $L_{in}$,$R_{in}$. This causes in this specific case, and in an advantageous embodiment of the invention, the reduction of the stereo balanced widening network BSWN into the simple structure shown in FIG. 6, in which structure the four filtering means 1,2,3,4 can, in practice, be implemented by using only two convolutions. Said convolutions take place in the linear low-pass filters 65 and 66, respectively. The reduced network structure shown in FIG. 6 is very robust numerically, and thus it is very suitable for implementation in fixed point arithmetic.

The balanced stereo widening network BSWN according to the invention can be used as a stand-alone signal processing method, but in practice it is likely that it will be used together with some kind of pre- and/or post-processing. FIG. 7 illustrates schematically the use of some possible pre- and post-processing methods, which said methods are well known in the art as such, but which could be used together with the balanced stereo widening network BSWN in order to further improve the quality of the listening experience.

FIG. 7 illustrates the use of decorrelation for signal pre-processing before the signals enter into the balanced stereo widening network BSWN. Decorrelation of the source signals $L_s$ and $R_s$ guarantees that the signals $L_{in}$ and $R_{in}$, which are the input to the balanced stereo widening network BSWN always differ to some degree even if the $L_s$ and $R_s$ signals from a digital source are identical. The effect of decorrelation is that the sound component which is common to both left and right channels, i.e. monophonic, is not heard as localized in a single point, but rather it is spread out slightly so that it is perceived as having a finite size in the sound scenery. This prevents the sound scenery or stage from becoming too "crowded" near the centre. In addition, the decorrelation effectively reduces the attenuation of the monophonic component in the transition band between $f_{low}$ and $f_{high}$ caused by the interference between the direct path and cross-talk path. Decorrelation can be implemented using two complementary comb-filters as indicated in FIG. 7. Comb-filters with a common delay of the order 15 ms are suitable for this purpose. The values of the coefficients $b_0$ and $b_N$ can be set to, for example, 1.0 and 0.4, respectively. The different sign on $b_N$ in the two channels (in FIG. 7 $+b_N$ in the left channel and $-b_N$ in the right channel) ensures that the sum of the magnitudes of the two transfer functions remains constant irrespective of the frequency. Consequently, the comb decorrelation is balanced in a way similar to the balanced stereo widening network BSWN.

FIG. 7 further illustrates schematically the use of equalization, for example low-frequency boost, in order to compensate for the non-ideal frequency response of the headphones. Preferably, equalization that is used to restore the spectral frequency balance of the recording in playback using headphones, is implemented by post-processing so that it does not affect the excellent dynamic properties of the balanced stereo widening network BSWN.

It is obvious for a person skilled in the art that the present invention is not restricted solely to the embodiments presented above, but it can be freely modified within the scope of the appended claims.

It is possible to implement the method according to the invention also by using analog electronics, but it is obvious for anyone skilled in the art that the preferred embodiments are based on digital signal processing techniques. The digital signal processing structures of the balanced stereo widening network BSWN, for example the linear phase low-pass filtering in the cross-talk path, can also be realized in many other ways. Different techniques for this are well documented in literature.

The method according to the invention is intended for converting audio material having signals in the general two-channel stereo format for headphone listening. This includes all audio material, for example speech, music or effect sounds, which are recorded and/or mixed and/or otherwise processed to create two separate audio channels, which said channels can also further contain monophonic components, or which channels may have been created from a monophonic single channel source for example, by decorrelation methods and/or by adding reverberation. This also allows the use of the method according to the invention for improving the spatial impression in listening different types of monophonic audio material.

The media providing the stereo signals for processing can include, for example, CompactDisc™, MiniDisc™, MP3 or any other digital media including public TV, radio or other broadcasting, computers and also telecommunication devices, such as multimedia phones. Stereo signals may also be provided as analog signals, which, prior to the processing in a digital BSWN network, are first AD-converted.

The signal processing device according to the invention can be incorporated into different types of portable devices, such as portable players or communication devices, but also into non-portable devices, such as home stereo systems or PC-computers.

What is claimed is:

1. A method for converting two-channel stereo format left (L) and right (R) channel input signals ($L_{in}$,$R_{in}$) into left and right channel output signals ($L_{out}$,$R_{out}$), in which method left direct path ($L_d$) and left cross-talk path ($L_X$) signals are formed from the left input signal ($L_{in}$), and correspondingly right direct path ($R_d$) and right cross-talk path ($R_X$) signals are formed from the right input signal ($R_n$), and the left output signal ($L_{out}$) is formed by combining said left direct-path ($L_d$) and said right cross-talk path ($R_x$) signals, and correspondingly, the right output signal ($R_{out}$) is formed by combining said right direct-path ($R_d$) and said left cross-talk path ($L_x$) signals, which said left and right channel output signals ($L_{out}$,$R_{out}$) thereby become suitable for headphone listening, characterized in that the direct path signals ($L_d$,$R_d$) each are formed using filtering (1,3) associated with first frequency dependent gain ($G_d$), the cross-talk path signals ($L_x$,$R_x$) each are formed using filtering (2,4) associated with second frequency dependent gain ($G_x$) and by adding interaural time difference (ITD) (5,6), said first and second frequency dependent gains ($G_d$, $G_x$) are given a common substantially constant reference value below a first frequency limit ($f_{low}$), said first frequency dependent gain ($G_d$) is given a substantially constant value significantly greater than said reference value, and said second frequency dependent gain ($G_x$) is given a substantially constant value significantly less than said reference value above a second frequency limit ($f_{high}$), where said second frequency limit ($f_{high}$) is greater than said first frequency limit ($f_{low}$), and said interaural time difference (ITD) is given a frequency independent constant value or alternatively a frequency dependent value.

2. The method according to claim 1, characterized in that said first and second frequency dependent gains ($G_d$, $G_x$) are given both a value of one below said first frequency limit ($f_{low}$), and said first frequency dependent gain ($G_d$) is given a value of 2, and said second frequency dependent gain ($G_x$) is given a value of zero above said second frequency limit ($f_{high}$).

3. The method according to claim 1, characterized in that said direct path signals ($L_d$,$R_d$) both are scaled by a first scaling factor ($S_d$) and said cross-talk path signals ($L_x$,$R_x$) both are scaled by a second scaling factor ($S_x$) in order to make the sum amplitude of the output signals ($L_{out}$,$R_{out}$) to substantially match the sum amplitude of the input signals ($L_{in}$,$R_{in}$).

4. The method according to claim 3, characterized in that the said first and second scaling factors ($S_x$,$S_d$) both are given a value of 0.5.

5. The method according to claim 1, characterized in that said first frequency limit ($f_{low}$) is given a value around 1 kHz and said second frequency limit ($f_{high}$) is given a value around 2 kHz.

6. The method according to claim 1, characterized in that the interaural time difference (ITD) is given value/values below 1 ms.

7. A signal processing device (BSWN) for converting two-channel stereo format left (L) and right (R) channel input signals ($L_{in}$,$R_{in}$) into left and right channel output signals ($L_{out}$,$R_{out}$) suitable for headphone listening, characterized in that the signal processing device (BSWN) comprises at least first filtering means (1) associated with first frequency dependent gain ($G_d$) to form left direct path signal ($L_d$) from said left input signal ($L_{in}$), second filtering means (2) associated with second frequency dependent gain ($G_x$) in serial with first delay adding means (5) associated with interaural time difference (ITD) to form left cross-talk path signal ($L_x$) from said left input signal ($L_{in}$), associated with interaural time difference (ITD) to form left cross-talk path signal ($L_x$) from said left input signal ($L_{in}$), third filtering means (3) associated with first frequency dependent gain ($G_d$) to form right direct path signal ($R_x$) from said right input signal ($R_{in}$), fourth filtering means (4) associated with second frequency dependent gain ($G_x$) in serial with second delay adding means (6) associated with interaural time difference (ITD) to form right cross-talk path signal ($R_x$) from said right input signal ($R_{in}$), first combining means (7) to form the left output signal ($L_{out}$) by combining said left direct-path ($L_d$) and said right cross-talk path ($R_x$) signals, and correspondingly, second combining means (8) to form the right output signal ($R_{out}$) by combining said right direct-path ($R_d$) and said left cross-talk path ($L_x$) signals, and said first and second frequency dependent gains ($G_d$,$G_x$) having a common constant reference value below a first frequency limit ($f_{low}$), said first frequency dependent gain ($G_d$) having a substantially constant value significantly greater than said reference value, and said second frequency dependent gain ($G_x$) having a substantially constant value significantly less than said reference value above a second frequency limit ($f_{high}$), where said second frequency limit ($f_{high}$) is greater than said first frequency limit ($f_{low}$), and said interaural time difference (ITD) is having a frequency independent constant value or alternatively a frequency dependent value.

8. The signal processing device (BSWN) according to claim 7, characterized in that said first and second frequency dependent gains ($G_d$, $G_x$) have a value of one below said first frequency limit ($f_{low}$), and said first frequency dependent gain ($G_d$) has a value of 2, and said second frequency dependent gain ($G_x$) has a value of zero above said second frequency limit ($f_{high}$).

9. The signal processing device (BSWN) according to claim 7, characterized in that the direct paths ($L_d$,$R_d$) each comprise first scaling means (9,11) associated with a first scaling factor ($S_d$) and the cross-talk paths ($L_x$,$R_x$) each comprise second scaling means (10,12) associated with a second scaling factor ($S_x$) in order to scale each path to make the sum amplitude of the output signals ($L_{out}$,$R_{out}$) to substantially match the sum amplitude of the input signals ($L_{in}$,$R_{in}$).

10. The signal processing device (BSWN) according to claim 8, characterized in that said first and second scaling factors ($S_d$,$S_x$) both have a value of 0.5.

11. The signal processing device (BSWN) according to claim 7, characterized in that said first frequency limit ($f_{low}$) has a value around 1 kHz and said second frequency limit ($f_{high}$) has a value around 2 kHz.

12. The signal processing device (BSWN) according to claim 7, characterized in that the interaural time difference (ITD) has value/values below 1 ms.

13. The signal processing device (BSWN) according to claim 7, characterized in that the signal processing device (BSWN) is a digital signal processor and/or digital signal processing network.

14. The signal processing device (BSWN) according to claim 13, characterized in that the first (1) and second (2) filtering means, and correspondingly the third (3) and fourth (4) filtering means are formed using a specific digital filter structure (41), in which filter structure the output of a linear phase low-pass filter (42;52) is combined with the output of a parallel digital delay line (43;53) having delay equal to the group delay of said low-pass filter (42;53).

15. The signal processing device (BSWN) according to claim 14, characterized in that the first (1), second (2), third (3) and fourth (4) filtering means are implemented using reduced network structure (FIG. 6) based on performing two convolutions.

16. The signal processing device (BSWN) according to claim 13, characterized in that the input signals ($L_{in}$,$R_{in}$) are preprocessed using a method that performs decorrelation.

* * * * *

UNITED STATES PATENT AND TRADEMARK OFFICE

CERTIFICATE OF CORRECTION

PATENT NO. : 6,771,778 B2
DATED : August 3, 2004
INVENTOR(S) : Ole Kirkeby

It is certified that error appears in the above-identified patent and that said Letters Patent is hereby corrected as shown below:

Column 11,
Line 50, delete "($R_n$)" and substitute -- ($R_{in}$) --

Column 12,
Line 58, delete "($R_x$)" and substitute -- ($R_d$) --

Signed and Sealed this

Twenty-third Day of November, 2004

JON W. DUDAS
*Director of the United States Patent and Trademark Office*